US005402140A

United States Patent [19]

Rodeffer

[11] Patent Number: 5,402,140

[45] Date of Patent: Mar. 28, 1995

[54] HORIZON-TO-HORIZON TVRO ANTENNA MOUNT

[75] Inventor: Charles E. Rodeffer, Burlington, Iowa

[73] Assignee: Winegard Company, Burlington, Iowa

[21] Appl. No.: 110,167

[22] Filed: Aug. 20, 1993

[51] Int. Cl.[6] ..... H01Q 3/02; H01Q 1/12; H01Q 3/00

[52] U.S. Cl. ..... 343/882; 343/878; 343/766; 248/232

[58] Field of Search ..... 343/882, 880, 878, 883, 343/763, 765, 766; 248/232, 124, 178, 179; H01Q 3/02, 1/12, 3/00

[56] References Cited

U.S. PATENT DOCUMENTS

| | | | |
|---|---|---|---|
| 3,952,984 | 4/1976 | Dimitry | 343/882 |
| 3,987,452 | 10/1976 | Codet | 343/765 |
| 4,126,865 | 11/1978 | Longhurst | 343/766 |
| 4,235,405 | 11/1980 | Carey | 343/882 |
| 4,528,569 | 7/1985 | Felter et al. | 343/882 |
| 4,626,864 | 12/1986 | Micklethwaite | 343/766 |
| 4,628,323 | 12/1986 | Crean | 343/882 |
| 4,644,365 | 2/1987 | Horning | 343/882 |
| 4,663,635 | 5/1987 | Wu | 343/765 |
| 4,819,006 | 4/1989 | Whitesides | 343/880 |

*Primary Examiner*—Donald Hajec
*Assistant Examiner*—Hoanganh Le
*Attorney, Agent, or Firm*—Dorr, Carson, Sloan & Peterson

[57] ABSTRACT

A mounting assembly including a casing having an outer surface attached to a TVRO antenna and having an inner surface and at least one first guide slot positioned on the inner surface of the casing. An inner tube is located inside the casing and has portions which extend out of the casing for attaching to the mounting pole. At least one second guide slot is formed through the inner tube. One of the first or second guide slots is non-linear. The casing is rotated by a spider-like mechanism having drive arm having a first end nested in the first guide slot, a body passing through the second guide slot. A leadscrew passes through the spider like mechanism and a motor coupled to one end of the leadscrew turns the leadscrew causing the spider like mechanism to move vertically along the leadscrew, which in turn causes the casing to rotate with respect to the inner tube.

20 Claims, 3 Drawing Sheets

Fig. 1
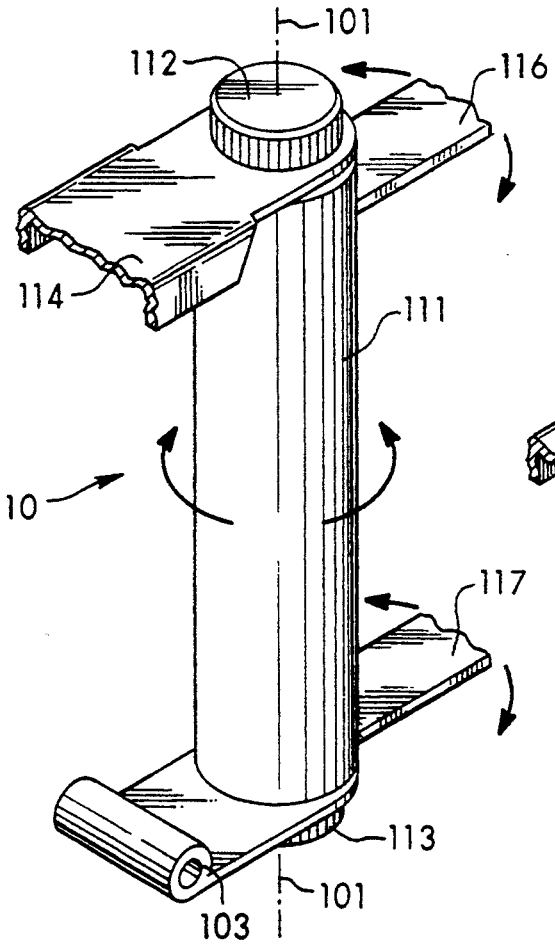
Fig. 2
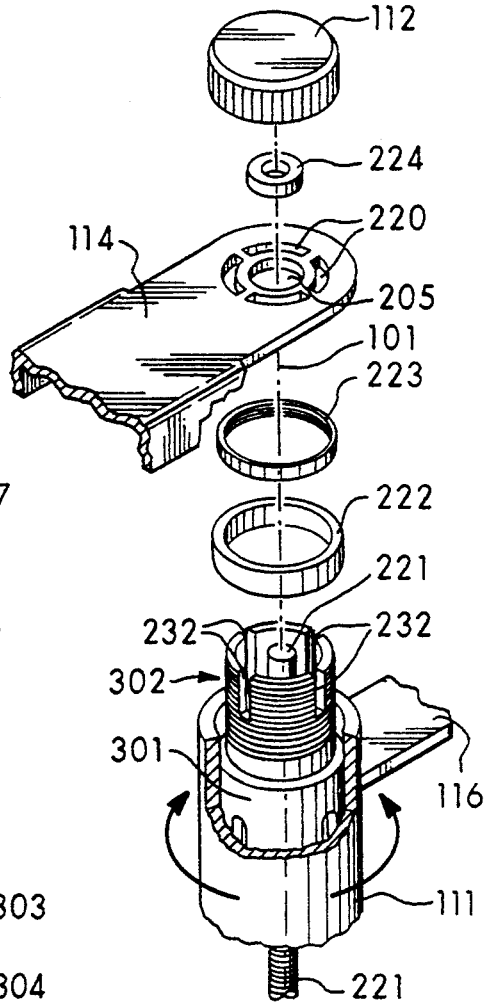
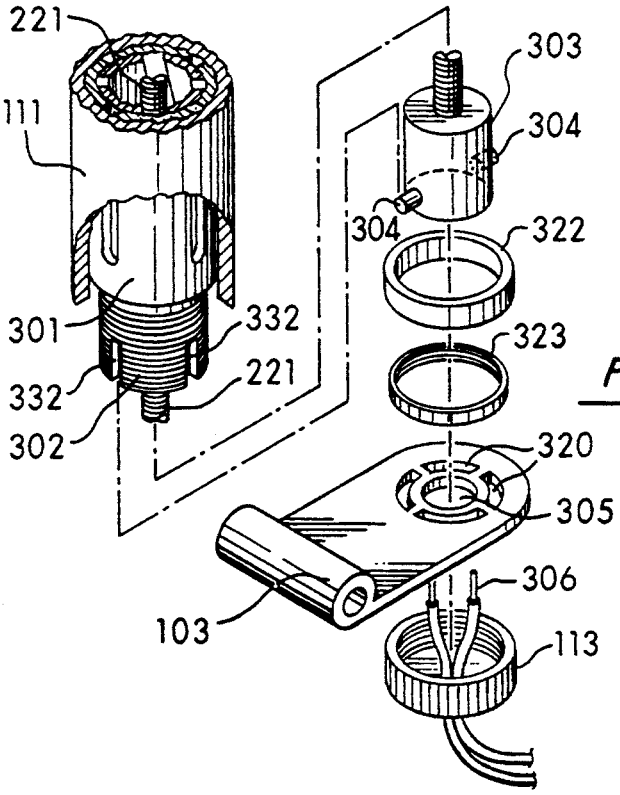
Fig. 3

HORIZON-TO-HORIZON TVRO ANTENNA MOUNT

BACKGROUND OF THE INVENTION

FIELD OF THE INVENTION

The present invention relates to antenna mounts and, in particular, the present invention relates to an antenna mount for attaching a TVRO antenna to a pipe mast anchored to the ground, the mount capable of aligning the antenna with any of several satellites positioned within a horizon-to-horizon view of the antenna.

STATEMENT OF THE PROBLEM

Satellite transmitted television is enjoying tremendous growth around the world. A satellite television system includes several geostationary satellites positioned in the Clark Belt around the earth that transmit microwave signals to a receiving antenna positioned on the ground. Usually the receiving antenna is a parabolic dish of substantial size to receive the relatively low power transmission from the satellite. Also, the receiving antenna must be aimed accurately at the transmitting satellite to receive the transmitted signal.

Each satellite transmits a different set of programming on a limited number of channels. At any given location on earth, several satellites are overhead, spaced from each other from horizon to horizon. Therefore, it is advantageous for a user to be able to reposition the receiving antenna to aim at any of the several satellites that are overhead a given position to access a greater amount and variety of programming.

Typically the antenna includes a positioning mechanism or actuator to provide for angular motion of an antenna structure with respect to a base structure to which the antenna is secured. The actuator must be a rugged mechanism to endure the mechanical stress caused by the weight of the antenna and effects of wind on the large surface area of the antenna. Also, the positioning mechanism must be accurate to provide reception of the transmitted signal.

Because satellite receiving antennae are located outdoors, the mount and actuator are exposed to the elements. Rain, snow and dirt degrade the positioning mechanism making it more difficult to move the antenna quickly and maintain an accurate position once a particular satellite is found. Moreover, the effects of weather age the antenna mount rapidly, increasing the effort required to maintain the antenna mount. This is particularly unacceptable when the antenna is located in a remote location where regular maintenance is difficult.

U.S. Pat. No. 4,126,865 issued to Longhurst et al. on Nov. 21, 1978 describes an antenna mount including an external motor that drives a crank that is coupled to the dish antenna by tie-rod arrangement. The crank and tie-rod arrangement are exposed to the elements. Also, the crank and tie-rod arrangement disclosed is suitable for slow tracking of a single satellite across the horizon, but cannot move the large satellite dish rapidly enough to provide rapid switching between several geostationary satellites.

U.S. Pat. No. 3,987,452 issued to Godet et al on Oct. 19, 1976 describes an antenna mount designed to move an antenna in three axes from horizon-to-horizon in any direction. This design is more complex than necessary as only single axis rotation is needed to access geostationary television satellites. The rotation mechanism used by Godet et al. uses a complex system of belts, pulleys, rollers, and multiple motors and joints to provide horizon-to-horizon coverage.

U.S. Pat. No. 4,663,635 issued to Wu on May 5, 1987 shows a mount for a dish antenna that uses a motor to drive the antenna via a worm-gear arrangement. Portions of the worm gear arrangement are exposed to the elements. U.S. Pat. No. 4,626,864 issued to Mickleth-waite on Dec. 2, 1986 shows an antenna mount using motor-driven gears to move the antenna. In this design, both the motor and gears are protected by an external housing.

A need exists for an antenna mount that provides horizon-to-horizon positioning capability to maximize the number of satellites that can be accessed by the receiving antenna. Also, an antenna mount is needed that is rugged and protects the positioning mechanism from effects of weather to provide a long, low maintenance life span for the antenna.

SOLUTION TO THE PROBLEM

The present invention provides a solution to the stated problem by providing an antenna mount having a positioning mechanism with. only a few moving parts located inside a protective casing. The mounting assembly includes a casing having an outer surface attached to the antenna. A number of first guide slots positioned on the inner surface of the casing, either by forming them directly in the casing or in a separate tube that nests inside the casing.

An inner tube is located inside the casing, and has a diameter selected so that the casing can rotate freely with respect to the inner tube. The inner tube also has top and bottom portions extending outside the casing. A number of second guide slots are formed in the inner tube extending from the inner surface to the outer surface of the inner tube. One of either the first or second slots are nonlinear, preferably helical shaped. The top and bottom portions of the inner tube are attached to the mounting pole so that the inner tube cannot rotate with respect to the mounting pole.

The casing is rotated by a driving mechanism including a spider-like structure having a threaded central nut and several drive arms extending outward from the central nut. Each drive arm has a first end nested in the first guide slot, a body passing through the second guide slot, and a second end attached to the nut. A threaded leadscrew passes through the threaded central nut. One end of the leadscrew is attached to a reversible motor. The reversible motor is mounted to the inner tube.

As the motor turns the leadscrew, the spider-like structure moves up and down along the leadscrew. Because one of the first or second slots is helical, the vertical motion of the drive arm is translated into continuous rotational motion of the casing with respect to the inner tube.

SUMMARY OF THE INVENTION

Briefly stated, the present invention includes a mounting assembly for a TVRO antenna comprising a casing having an outer surface attached to the antenna and having an inner surface and at least one first guide slot positioned on the inner surface of the casing. An inner tube is located inside the casing, the inner tube having an inner surface, and having an outer surface freely rotatable within the inner surface of the casing. Portions of the inner tube extend out of the casing and are attached to the mounting pole. At least one second guide slot is formed in the inner tube extending from the inner surface to the outer surface of the inner tube. One of the first or second guide slots is nonlinear.

The casing is rotated by a drive arm having a first end nested in the first guide slot, a body passing through the second. guide slot, and a second end attached to a nut located in a central axis of the mounting assembly. A leadscrew passes through the nut and a motor coupled to one end of the leadscrew turns the leadscrew causing the nut and drive arm to move up and down which in turn causes the casing to rotate with respect to the inner tube.

DESCRIPTION OF THE DRAWING

FIG. 1 is perspective view of an assembled antenna mount in accordance with the present invention;

FIG. 2 is a partially exploded view of an upper portion of the antenna mount shown in FIG. 1;

FIG. 3 is a partially exploded view of a lower portion of the antenna mount shown in FIG. 1;

SPECIFICATION

A. Overview

Figure 4:
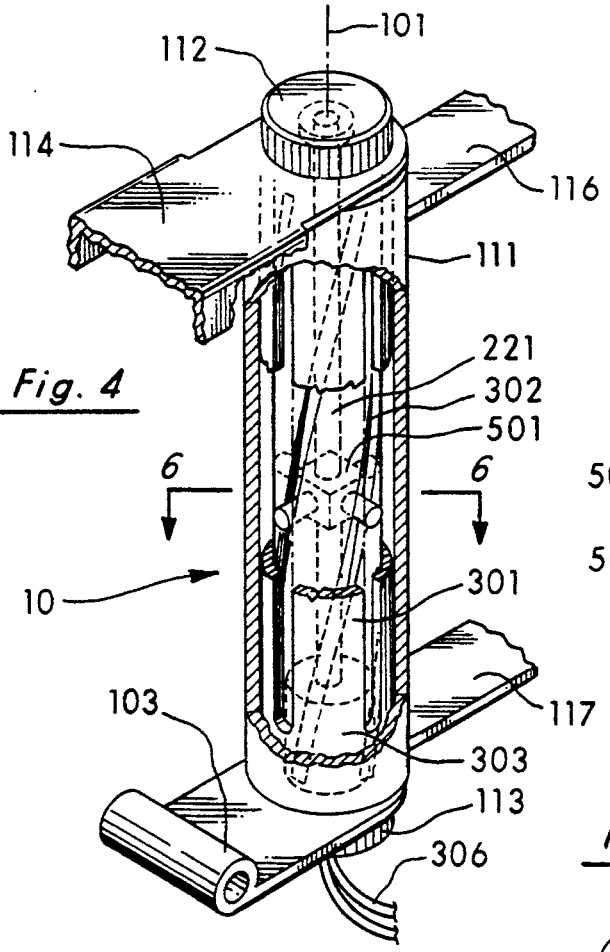
FIG. 4 is a cut-away view illustrating internal feature of the antenna mount shown in FIG. 1.

FIG. 1 illustrates a mounting assembly 10 in accordance with the present invention. Mounting assembly 10 includes a casing 111 that is attached to an upper dish mount 116 and a lower dish mount 117. At the top of mounting assembly 10 is an upper mounting bracket 114. At the bottom of mounting assembly 10 is a lower mounting bracket 104 which is a flat plate with a welded sleeve 103 formed thereon. Caps 112 and 113, which are described in greater detail in reference to FIG. 2 and FIG. 3, seal against upper mounting bracket 114 and lower mounting bracket 104 to provide mechanical support for mounting brackets 114 and 104 as well as a weather resistant seal against the internal components (shown in FIG. 2–FIG. 8) of mounting assembly 10. Unless otherwise specified, all components of mounting assembly 10 are preferably fabricated from steel, stainless steel, or other steel alloy. Depending on the demands and budget of a particular application, however, other materials are structurally suitable such as metals, plastics or composite materials.

Figure 9:
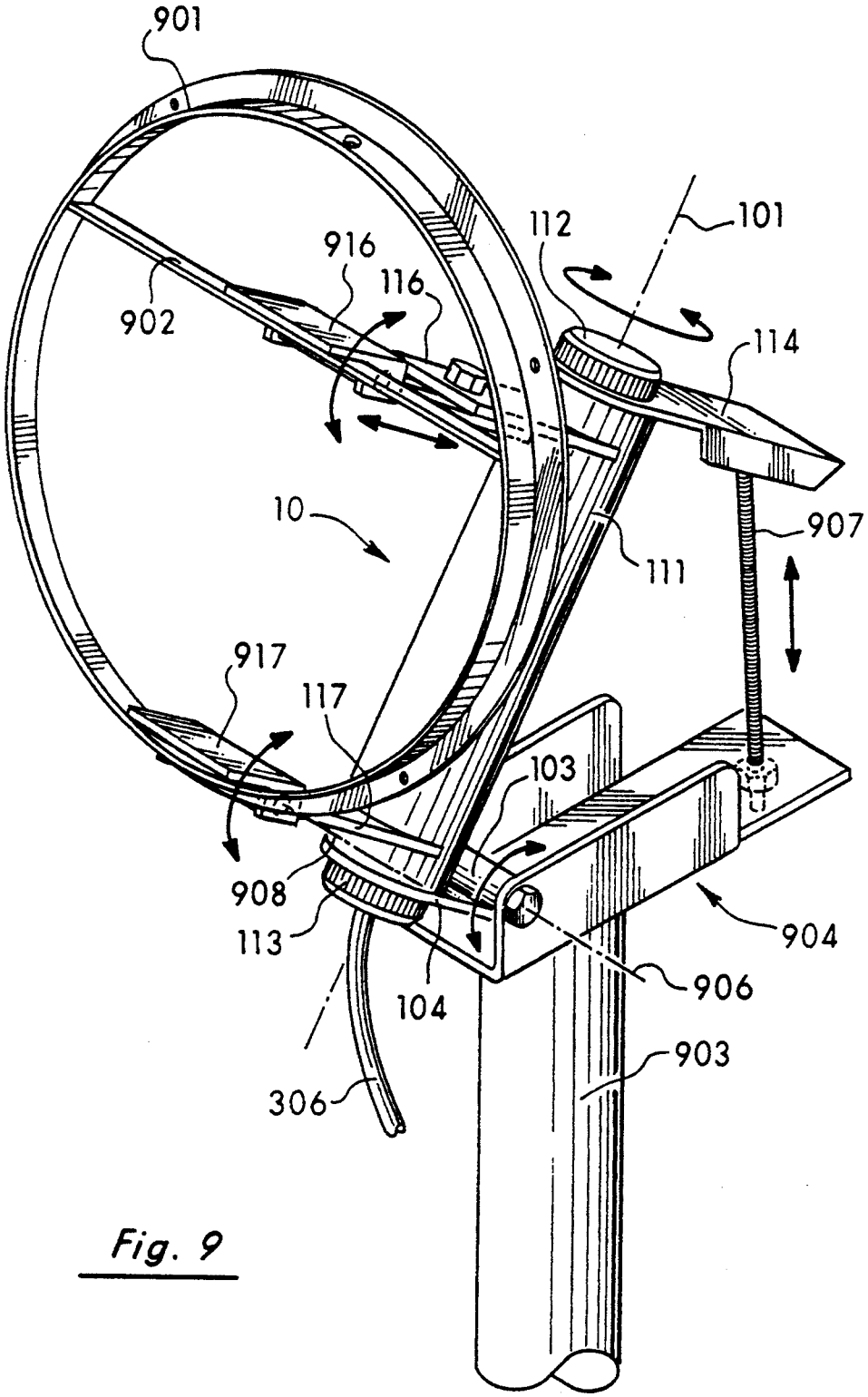
FIG. 9 illustrates a perspective view of the antenna mount of FIG. 1 attached to a dish antenna support.

Upper dish mount 116 and lower dish mount 117 are designed to mechanically couple to frame 901 and frame support 902 shown in FIG. 9. Therefore, upper dish mount 116 and lower dish mount 117 will vary in design depending on the particular structure of frame 901 and support 902. Frame 901 is designed to attach to a dish antenna (not shown). Lower mounting bracket 104 is designed to mechanically couple to a headpiece 904 (FIG. 9) which is mounted on top of a mounting pole 903.

Upper mounting bracket 114 attaches to rod 907 for stabilizing and supporting mounting assembly 10, and for holding a central axis 101 of mounting assembly 10 in alignment with the Earth's rotational axis. Rod 907 is preferably threaded to allow easy adjustment of mounting assembly 10 to compensate for the geographic location of the antenna. Sleeve 103 allows mounting assembly 10 to be rotated or tipped about axis 906 running through a center of sleeve 103, as suggested by bold arrows in FIG. 9. Mounting assembly 10 will tip about axis 906 as threaded rod 907 is adjusted.

In operation, a parabolic dish (not shown) is mounted on frame 901. Frame 901 is attached to the outside of casing 111 via upper dish mount 116 and lower dish mount 117. The mechanism inside casing 111, described hereinafter, causes casing 111 to rotate, as suggested by arrows in FIG. 9, with respect to central axis 101. Because upper mounting bracket 114 and lower mounting bracket 104 are attached to pole 903, which is in turn embedded in the ground, the antenna scans the heavens from horizon-to-horizon as casing 111 rotates. In accordance with the present invention, the electrical and mechanical workings that drive rotation of casing 111 with respect to stationary mounting pole 903 are enclosed in casing 111.

Power is supplied to the electrical components protected by casing 111 via power lines 306 which are visible in FIG. 9. Alternatively, non-electric driving force such as pneumatic or mechanical drivers inside or external to mounting assembly 10 may be used in which case power lines 306 are replaced by piping, cables, or the like.

In summary, mounting assembly 10 in accordance with the present invention includes a casing 111 that is driven to rotate about a central axis 101. Upper and lower mounts 116 and 117 attached to casing 111 are for attaching to a dish antenna. Although the preferred embodiment is described in terms of a dish antenna, it should be understood that mounting assembly 10 could also be used to drive other types of antennae, or other devices that must aim at or track an object in the sky, such as a solar panel, low orbit satellites, incline satellites (non-stationary). Mounting assembly 10 includes an internal driving mechanism, described hereinafter, that is attached to a mounting pole via brackets 114 and 104 so that the internal driving mechanism does not rotate with respect to central axis 101. In this manner, a rugged mounting assembly is provided that is capable of rotating an antenna about a single axis 101 while protecting the internal driving mechanism from the wearing and aging effects of weather.

B. Assembly Details of the Internal Drive Mechanism

The details of the drive mechanism positioned inside casing 111 are illustrated in FIG. 2 through FIG. 5. FIG. 2 shows a partially exploded view of an upper portion of mounting assembly 10. Inside casing 111 are guide tube 301 and inner tube 302. Guide tube 301 nests completely inside casing 111 and cannot rotate with respect to casing 111. Inner tube 302 has an upper portion extending beyond the end of casing 111. The upper portion of inner tube 302 is threaded and includes a number of mounting notches 232. Inner tube 302 is sized to allow rotation of casing 111 and guide tube 301 with respect to inner tube 302. In other words, the outside diameter of inner tube 302 is smaller than the inside diameter of casing 111 or guide tube 301.

Inside inner tube 302 is a threaded leadscrew 221 that is aligned with central axis 101 and extends substantially to the top of inner tube 302. Threaded leadscrew 221 has an end portion that extends into the threaded upper portion of inner tube 302. The end portion of leadscrew 221 is desirably free of threads.

Cap 112, which screws onto a threaded upper portion of inner tube 302, conceals ring bearings 222 and 224 used to provide mechanical support to the internal drive mechanism. Upper guide ring bearing 222 has inside and outside diameters that are similar to those of guide tube 301. Upper guide ring bearing 222 fits around inner tube 302 so that when upper guide ring bearing 222 is in place its upper surface is substantially flush with the upper surface of casing 111, although precise alignment is not crucial. Preferably, upper guide ring bearing 222 comprises a roller bearing brass although other durable, machinable, low friction materials are known and are suitable.

Guide ring bearing 222 is held in place by retainer 223 which screws onto the threaded upper portion of inner tube 302. Retainer 223 preferably comprises steel or stainless steel, although other suitable materials will be apparent to skilled machinists. It is important that retainer 223 and guide bearing 222 slidably engage each other to allow free rotation of casing 111 and guide tube 301 with respect to inner tube 302.

Upper mounting bracket 114 is provided with a number of arc-shaped mounting slots 220 concentrically positioned about central axis 101. Mounting slots 220 are sized and positioned to mate with notches 232 in the threaded upper portion of inner tube 302. A hole 205 in the center of mounting slots 220 in mounting bracket 114 is sized to securely hold top bearing 224. Top bearing 224 comprises brass in the preferred embodiment, but may also comprise other well known durable, low friction materials. The inside diameter of top bearing 224 is sized to fit onto the unthreaded end portion of leadscrew 221, thereby holding leadscrew 221 in alignment with central axis 101.

An exploded view of a lower portion of the mounting assembly 10 in accordance with the present invention is illustrated in FIG. 3. Many elements shown in FIG. 3 are analogous to elements shown in FIG. 2, allowing for reduced parts inventories for the manufacturer and lower manufacturing cost. A lower threaded portion of inner tube 302 extends beyond casing 111 and includes lower mounting notches 332 that are similar to upper mounting notches 232 described in reference to FIG. 2. Threaded leadscrew 221 extends through the length of inner tube 302 and has an end attached to motor 303.

Motor 303 is a reversible motor, preferably a DC motor for turning leadscrew 221 in a clockwise and counterclockwise direction. Alternatively, motor 303 may be replaced by a pneumatic or mechanical driving mechanism. Motor 303 may be a stepping motor to accurately control the position of the antenna, but need not be. Motor 303 desirably includes some form of position feedback mechanism (not shown) which may be optoelectronic or Hall effect sensors, or the like. This type of position feedback is well known and easily adapted to the mounting assembly in accordance with the present invention to provide accurate positioning control.

Motor tabs 304 are used for mounting motor 303 in lower mounting notches 332 in inner tube 302. It is important that motor 302 does not rotate with respect to inner tube 302, and motor tabs 304 are one way of mounting motor 303 to inner tube 302 that prevents rotation. Motor tabs 304 preferably are not longer than the thickness of the sidewall of inner tube 302 so that they do not extend beyond the outer surface of inner tube 302 when motor 303 is in position. Other suitable mounting means include friction mounting, or retaining screws through the sidewall of inner tube 302 to motor 303.

Lower guide tube ring bearing 322 and retaining ring 323 perform the same function in a similar manner as upper guide tube ring bearing 222 and retaining ring 223 described in reference to FIG. 2. Lower mounting bracket 104 includes a number of arcuate mounting slots 320 that are designed to mate with mounting notches 332 in the threaded bottom portion of inner tube 302. A hole 305 in the center of mounting slots 320 allows power lines 306 to pass through lower bracket 104 to motor 303. Power lines 306 also pass through a hole (not visible) in lower cap 113 to a power source (not shown). Other wires (not shown) for providing control or feedback information to the internal drive mechanism could also pass through lower cap 113 and hole 305 if desired.

FIG. 4 illustrates a cut-away view of mounting assembly 10 in accordance with the present invention in a manner that indicates the cooperation among the elements of the internal drive mechanism described above. Casing 111, guide tube 301, inner tube 302 and leadscrew 221 are all coaxially aligned with central axis 101. Guide tube 301 and inner tube 302 include features described in greater detail hereinafter. Also, a spider-like assembly 501 is mounted on leadscrew 221, and is described in detail in reference to FIG. 5.

In summary, guide tube 301 and casing 111, which do not rotate with respect to each other, are positioned around inner tube 302 so that casing 111 can rotate with respect to inner tube 302. Ring bearings 222 and 322 are held by retainers 223 and 323 to maintain alignment of casing 111, guide tube 301 and inner tube 302. Threaded leadscrew 221 is aligned with central axis 101 and passes through the center of inner tube 302. Upper and lower mounting brackets 114 and 104 include mounting slots 220 and 320 that mate with notches in the upper and lower portions of inner tube 302 to securely attach mounting brackets 114 and 104 to inner tube 302. Mounting bracket 114, which is mechanically coupled to a mounting pole 903 (FIG. 9) in use, holds mounting assembly 10 in place while casing 111 can be driven to rotate about central axis 101. Caps 112 and 113 screw onto the threaded upper and lower portions of inner tube 302 and seal against mounting brackets 114 and 104 to protect the internal drive mechanism from the elements.

C. Component Details of the Internal Drive Mechanism

Figure 5:
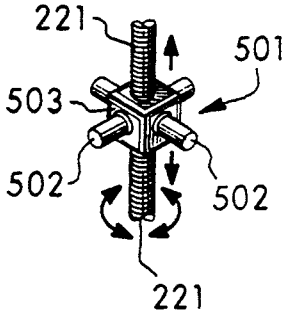
FIG. 5 is a detailed perspective view of a portion of a drive mechanism for the antenna mount in accordance with the present invention.

FIG. 5 through FIG. 8 illustrate details of important component parts of the internal drive mechanism housed inside casing 111. As shown in FIG. 5, spider-like apparatus 501 is positioned on leadscrew 221 inside inner tube 302 (shown in FIG. 2 through FIG. 4). Spider-like apparatus 501 includes a threaded nut 503 that fits onto threaded leadscrew 221. Nut 503 moves up and down, as suggested by vertical arrows in FIG. 5, as leadscrew 221 is turned, as suggested by curved arrows in FIG. 5. Nut 503 is preferably cube-shaped, but other shapes are suitable. At least one drive arm 502 extends away from nut 503. As shown in FIG. 5, one drive arm 502 extends perpendicularly away from each of the four side walls of cube-shaped nut 503. Nut 503 and drive arms 502 comprise steel or a similar, durable metal alloy, although other durable, machinable material including plastics, ceramics, ant the like in the preferred embodiment.

Figure 6:
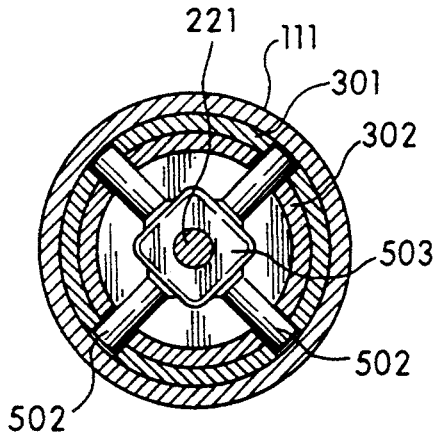
FIG. 6 shows a cross-section view of the antenna mount of FIG. 4.

As seen in the cross-section view of FIG. 6, drive arms 502 extend through a first set of guide slots 801 (FIG. 8) formed in inner tube 302. An end of each drive arm 502 fits into a second set of guide slots 701 (FIG. 7) formed in guide tube 301. At this point it should be noted that the primary function of guide tube 301 is to provide the second set of guide slots 701 such that the second set of guide slots 701 cannot rotate with respect to casing 111. Alternatively, second guide slots 701 can be formed integrally with casing 111 by creating grooves extending partially through the sidewall of casing 111. Forming grooves partially through a tube sidewall is a difficult machining task, however, and so it is recommended. that guide tube 301 and casing 111 be formed as separate components as illustrated in FIG. 6 and FIG. 7.

Figure 7:
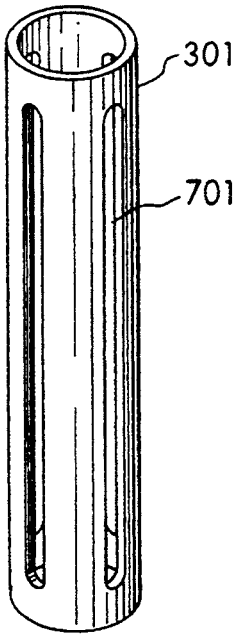
FIG. 7 shows a perspective view of a portion of the antenna mount by the present invention.

As shown in FIG. 7, guide tube 301 is preferably a hollow cylinder-shaped tube with a circular cross-section. Second guide slots 701 formed through the sidewall of guide tub 301 are desirably substantially linear slots extending vertically along the length of guide tube 301. A guide slot 701 is provided for each drive arm 502 (FIG. 6). Also, each second guide slot 701 is sized so that an end of a drive arm 502 fits into guide slot 701 with minimal clearance to prevent lateral play, while allowing drive arms 502 to move vertically with little friction. Optionally, the end of each drive arm 502 can be oval of elliptical to act as a cam when inserted into guide slot 701 and rotated during assembly to provide a snug yet low friction coupling between guide slot 701 and drive arms 502.

Figure 8:
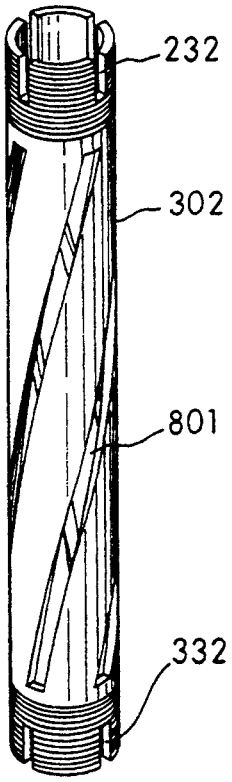
FIG. 8 illustrates a perspective view of another inner portion of the antenna mount in accordance with the present invention.

FIG. 8 illustrates details of inner tube 302, which is preferably a hollow cylinder-shaped tube with a circular cross-section. The diameter of inner tube 302 is selected to allow inner tube 302 to rotate freely inside guide tube 301. Upper and lower portions of inner tube 302 are threaded. The length of inner tube 302 is selected to allow both the upper and lower portions to extend beyond guide tube 301 and casing 111, as shown in FIG. 2 and FIG. 3. Upper mounting notches 232 are formed in the upper threaded portion of inner tube 302, while lower mounting notches 332 are formed in the lower threaded portion of inner tube 302.

First guide slots 801 formed through the sidewall of inner tube 302 are desirably nonlinear slots extending along the length of inner tube 302. First guide slots 801 are preferably helically shaped and are formed with a continuous curve. Desirably, an end of each guide slot 801 near upper mounting notches 232 is on an opposite side, or 180 degrees from, another end of the first guide slot 801 near lower mounting notches 332. This arrangement allows the dish antenna (not shown) to be rotated through 180 degrees or from horizon-to-horizon.

One first guide slot 801 is provided for each drive arm 502 (FIG. 6). Also, each first guide slot 801 is sized so that the body of a drive arm 502 passed through the first guide slot 801 with minimal clearance to prevent lateral play, while allowing drive arms 502 to move vertically with little friction.

In summary, spider-like apparatus is designed to move vertically when leadscrew 221 is rotated, forcing drive arms 502 up and down. Drive arms 502 pass through a first set of guide slots 801 formed in inner tube 302 and a second set of guide slots 701 formed in guide tube 301. Although the second set of guide slots 701 is best formed as a separated component from casing 111, they may be formed as an integral unit. As illustrated in FIG. 7 and FIG. 8, first guide slots 801 are helically shaped whereas second guide slots 701 are linear. Alternatively, first guide slots 801 may be linear and second guide slots 701 be nonlinear or helical, or both may be non-linear with differing curves with respect to each other. So long as one of guide slots 701 and 801 are not the same shape, the vertical motion of drive arms 502 will be translated into rotational motion of casing 111 about central axis 101.

D. Operation of the Mounting Assembly

FIG. 1, FIG. 4, and FIG. 9 viewed together illustrate the operation of horizon-to-horizon mounting assembly 10 in accordance with the present invention. Referring specifically to FIG. 9, pole 903 is fixed in the earth or a heavy concrete base to prevent its moving when the antenna is repositioned. Lower mounting bracket 104 is rigidly attached to pole 903 via headpiece 904. Because lower mounting bracket 104 is attached to inner tube 302, shown in FIG. 4, inner tube 302 cannot rotate with respect to pole 903.

To reposition the antenna (not shown) attached to frame 901 in FIG. 9, motor 303 is activated by applying power to power lines 306. Motor 303 causes leadscrew 211 to turn, moving nut 503 and drive arms 502 upward or downward. Because first guide slots 801 are curved, and second guide slots 801 are linear, drive arms 502, which extend through both first and second guide slots 801 and 701, force second guide slots 701 to turn or rotate as drove arms 502 move vertically.

Second guide slots 701, whether formed separately in guide tube 301 or integrally with casing 111, move together with casing 111 so that casing 111 rotates with respect to inner tube 302 when drive arm 502 moves up or down vertically. The antenna (not shown) is rigidly attached to casing 111 via frame 901 and brackets 916 and 917 in FIG. 9. Brackets 916 and 917 attach to dish mounts 116 and 117 so as to allow declination adjustment of the dish antenna about dish axis 908. Hence, when casing 111 rotates with respect to central axis 101 the antenna (not shown) rotates about central axis 101. Because the curve of the first guide slots can extend 180 degrees or more, as shown in FIG. 8, the antenna can be repositioned to aim at any satellite visible to the antenna from horizon-to-horizon.

E. Conclusion

By now it is apparent that an antenna mount which is very rugged and weather resistant is provided. The antenna mount in accordance with the present invention is suitable for moving dish antenna structures, yet is so compact that the entire drive mechanism is placed within a casing and sealed against weather damage. The TVRO antenna mount of the present invention is particularly suitable for remote locations where maintenance costs are high, and yet is structurally simple enough that is a cost-effective antenna mount for domestic satellite television reception.

It is to be expressly understood that the claimed invention is not to be limited to the description of the preferred embodiment but encompasses other modifications and alterations within the scope and spirit of the inventive concept. For example, the mount in accordance with the present invention can be used to position photovoltaic equipment rather than a dish antenna. Also, the single axis antenna mount in accordance with the present invention can be used alone or in combination with mechanics for provide other axes of rotation. Different materials including plastics, composites, and combinations of metal, plastic and composite material can be used to construct the elements of the antenna mount. Moreover, the casing 111 can be attached to a mounting pole while the inner tube 302 can be attached to a TVRO antenna, while the mechanism of the present invention operates in a manner substantially similar to the preferred embodiment described above. Accordingly, these and other like modifications of the described antenna mount are within the spirit and claims of the present invention.

I claim:

1. A mounting assembly for attaching a dish antenna to a mounting pole, the mounting assembly comprising:

a cylindrically shaped inner tube having an upper end and a lower end adapted for rigidly attaching the inner tube to the mounting pole, and having a sidewall having an inside surface and an outside surface;

a first guide slot formed in the sidewall of the inner tube extending from the inner surface to the outer surface;

a motor positioned inside the inner tube and aligned with the inner tube, the motor being rigidly mounted to the bottom portion of the inner tube;

a threaded leadscrew inside the inner tube and aligned with a central axis of the inner tube, the threaded leadscrew having one end attached to the motor and extending to the top portion of the inner tube;

a nut mounted on the threaded leadscrew, wherein the nut moves up and down along the length of the leadscrew when the leadscrew is rotated by the motor;

a cylindrically shaped guide tube, and having a sidewall having an inside surface and an outside surface, wherein the guide tube positioned coaxially with the inner tube and free to rotate about the inner tube;

a second guide slot formed through the sidewall along the length of the guide tube, wherein the first and second guide slots are not the same shape;

at least one drive arm affixed to the nut and extending away from the leadscrew through the first guide slot and into the second guide slot;

a cylindrically shaped casing surrounding the guide tube and attached to the guide tube in a manner to prevent rotation of the casing with respect to the guide tube; and a means attached to the casing for attaching the casing to an antenna.

2. The mounting assembly for attaching a dish antenna to a mounting pole of claim 1 further comprising:

a set of upper notches formed in the upper end of the inner tube;

a set of lower notches formed in the lower end of the inner tube;

an upper bracket having a first end and second end having a plurality of mounting slots positioned and sized to allow mounting of the second end of the upper bracket on the upper notches; and a lower bracket having a portion for attaching to a headpiece of a mounting pole and one end having a plurality of mounting slots positioned and sized to allow mounting of the lower bracket on the lower notches.

3. The mounting assembly for attaching a dish antenna to a mounting pole of claim 2 wherein the upper and lower ends of the inner tube are threaded, and the mounting assembly further comprises: an upper threaded cap that screws onto the upper end of the inner tube; a lower threaded cap that screws onto the lower end of the inner tube, wherein the upper cap seals against the second end of the upper bracket and the lower cap seals against the end of the lower bracket.

4. The mounting assembly for attaching a dish antenna to a mounting pole of claim 1 wherein the first guide slot is helically shaped and the second guide slot is substantially linear.

5. The mounting assembly for attaching a dish antenna to a mounting pole of claim 1 wherein the first guide slot is substantially linear and the second guide slot is helically shaped.

6. A mounting assembly for attaching a dish antenna to a mounting pole, the mounting assembly comprising:

a threaded leadscrew positioned in a central axis of the mounting assembly;

an inner tube having a sidewall, an upper portion, and a lower portion, the inner tube positioned coaxially with the leadscrew;

a number of helically shaped slots formed through the sidewall of the inner tube;

a motor mounted inside the lower portion of the inner tube attached to one end of the leadscrew for rotating the leadscrew in a clockwise and counterclockwise direction about the central axis;

a nut mounted on the threaded leadscrew wherein the nut moves up and down along the length of the leadscrew when the leadscrew is rotated;

a number of drive arms affixed to the nut and extending away from the leadscrew, wherein each of the number of drive arms passes through one of the number of helically shaped slots and has an end portion that extends beyond the sidewall of the inner tube;

a cylindrically shaped casing surrounding the inner tube and having a length selected so that the upper portion and lower portion of the inner tube extend beyond the casing;

slot means for guiding the at least one drive arm, wherein the end portion of the at least one drive arm fits into the slot means and the slot means cannot rotate with respect to the casing;

a first means connected to the upper and lower portions of the inner tube for attaching the mounting assembly to the mounting pole; and a second means connected to the casing for attaching the casing to an antenna.

7. The mounting assembly of claim 6 wherein the slot means for guiding comprise a number of linear slots extending vertically along an inside surface of the casing, wherein the end portion of each of the number of drive arms fits into one of the linear slots.

8. The mounting assembly of claim 7 wherein the slot means for guiding comprises a guide tube having a larger inside diameter than an outside diameter of the inner tube and nested inside the casing to prevent rotation of the guide tube with respect to the casing, wherein the guide tube includes a number of linear slots extending vertically along a sidewall of the guide tube, wherein the end portion each of the number of drive arms fits into a linear slot in the guide tube.

9. The mounting assembly of claim 6 wherein the upper portion and the lower portion of the inner tube include a number of notches aligned with the central axis, and the first means for attaching further includes a mounting bracket having a predetermined pattern of mounting slots formed therein, the mounting slots designed to mate with the notches.

10. The mounting assembly of claim 9 wherein the upper portion and the lower portion of the inner tube are threaded, and the means for attaching further includes a first and a second threaded caps sized to screw onto the upper and lower portions of the first cylinder for rigidly attaching the mounting bracket to the inner tube.

11. The mounting assembly of claim 6 wherein the nut is cube-shaped and includes a threaded hole passing from a lower face to an upper face for mounting the nut to the threaded leadscrew, and the mounting assembly further included four drive arms extending away from each side face of the cube-shaped nut.

12. The mounting assembly of claim 6 wherein the motor is a direct current reversible motor.

13. The mounting assembly of claim 6 wherein the motor, leadscrew, nut, drive arms, inner tube and slot means for guiding are positioned inside the casing.

14. A mounting assembly for attaching an antenna to a mounting pole, the mounting assembly comprising:

a tube-shaped casing having an outer surface rigidly attached to the antenna and having an inner surface, wherein the tube-shaped casing includes a plurality of guide slots affixed to the inner surface;

an inner cylinder having a plurality of curved slots formed in therein, each slot extending from near the top portion to near the bottom portion of the inner cylinder, the inner cylinder mounted inside the tube-shaped casing to allow rotation of the casing vis-a-vis the inner cylinder, the inner cylinder having top and bottom portions extending outside of the tube-shaped casing;

means connected to the inner cylinder and engaging the guide slots affixed to the inner surface of the tube-shaped casing for causing the tube-shaped casing to rotate with respect to the inner cylinder; and means for attaching the mounting pole to the top and bottom portions of the tube-shaped inner cylinder.

15. The mounting assembly of claim 14 further comprising a means connected to the top and bottom portions of the inner cylinder for sealing the inner cylinder.

16. The mounting assembly of claim 15 wherein the means for sealing also seals the tube-shaped casing.

17. A mounting assembly for attaching an antenna to a mounting pole, the mounting assembly comprising:

a tube-shaped casing having an outer surface rigidly attached to the antenna and having an inner surface;

guide slots affixed to the inner surface of the casing;

an inner cylinder having a plurality of curved slots formed in therein, each slot extending from near the top portion to near the bottom portion of the inner cylinder, the inner cylinder mounted inside the tube-shaped casing to allow rotation of the casing vis-a-vis the inner cylinder, the inner cylinder having top and bottom portions extending outside of the tube-shaped casing;

means for attaching the mounting pole to the top and bottom portions of the inner cylinder;

means connected to the tube-shaped casing for causing the tube-shaped casing to rotate with respect to the inner cylinder, wherein the means for causing the tube-shaped inner cylinder to rotate further comprises:

a threaded leadscrew positioned in a central axis of the mounting assembly;

a motor positioned inside the inner cylinder and connected to the threaded leadscrew for turning the leadscrew; and a spider-shaped nut threaded onto the threaded leadscrew and having a plurality of arms extending perpendicularly away from the central axis, wherein each of the arms of the spider-shaped nut extend through one of the curved slots in the inner cylinder to engage the guide slots affixed to the inner surface of the casing.

18. The mounting assembly of claim 17 wherein the plurality of guide slots are positioned vertically on an inside surface of the tube-shaped casing, wherein each of the arms extends into one of the guide slots, and the guide slots serve to prevent rotation of the spider-shaped nut with respect to the tube-shaped casing when the leadscrew is rotated.

19. The mounting assembly of claim 17 wherein each of the curved slots formed in the casing are helically shaped and a portion of the slot moves at the top end of the casing is approximately 180 degrees from a portion of the slot at the bottom end of the casing.

20. A mounting assembly for attaching an antennae to a mounting pole, the mounting assembly comprising:

a casing having an outer surface attached to the antenna and having an inner surface;

at least one first guide slot positioned on the inner surface of the casing;

a inner tube located inside the casing, the tube having an inner surface, and having an outer surface, wherein the inner tube is free to rotate with respect to the casing and the inner tube includes top and bottom portions extending outside of the casing;

at least one second guide slot extending from the inner surface to the outer surface of the inner tube, wherein the first and second guide slots are not the same shape;

a drive arm having a first end nested in the first guide slot, a body passing through the second guide slot, and a second end near a central axis of the mounting assembly;

motorized means mechanically coupled to the drive arm for causing the drive arm to move vertically between the upper end and the lower end of the inner tube, thereby causing rotation of the casing with respect to the inner tube; and means coupled to the mounting pole and the top and bottom portions of the inner tube for attaching the mounting pole to the top and bottom portions of the inner tube.

* * * * *